United States Patent [19]

Nakamura

[11] Patent Number: 4,505,236

[45] Date of Patent: Mar. 19, 1985

[54] VALVE OPERATING ARRANGEMENT OF AN INTERNAL COMBUSTION ENGINE

[75] Inventor: Makoto Nakamura, Yokohama, Japan

[73] Assignee: Nissan Motor Company, Limited, Japan

[21] Appl. No.: 499,253

[22] Filed: May 31, 1983

[30] Foreign Application Priority Data

Jun. 1, 1982 [JP] Japan ..... 57-93784
Jun. 9, 1982 [JP] Japan ..... 57-98930
Jan. 26, 1983 [JP] Japan ..... 58-9621[U]
Jan. 26, 1983 [JP] Japan ..... 58-10784

[51] Int. Cl.[3] ..... F01L 1/46
[52] U.S. Cl. ..... 123/90.27; 123/90.34
[58] Field of Search ..... 123/90.22, 90.33, 90.34, 123/90.36, 90.27

[56] References Cited

U.S. PATENT DOCUMENTS 3,352,293 11/1967 Hulten ..... 123/90.34 X
4,258,673 3/1981 Stoody, Jr. et al. ..... 123/90.34
4,333,426 6/1982 Gavasso et al. ..... 123/90.27
4,430,968 2/1984 Futakuchi et al. ..... 123/90.27

FOREIGN PATENT DOCUMENTS 257395 9/1926 United Kingdom ..... 123/90.34

*Primary Examiner*—William R. Cline
*Assistant Examiner*—Peggy A. Neils
*Attorney, Agent, or Firm*—Leydig, Voit, Osann, Meyer and Holt, Ltd.

[57] ABSTRACT

In an over-head cam type internal combustion engine, there is disposed a monoblock supporting member which is tightly seated on the cylinder head and supports thereon some of the essential parts of the valve operating mechanism, such as a rocker arm assembly and valve lifters. The monoblock supporting member is formed therein with a lubricant oil passage through which the lubricant oil for lubrication of the cam shaft, the cams on the cam shaft, the valve lifters and the rocker arms is carried.

17 Claims, 12 Drawing Figures

VALVE OPERATING ARRANGEMENT OF AN INTERNAL COMBUSTION ENGINE

BACKGROUND OF THE INVENTION

1. Field of the Invention

The present invention relates in general to an internal combustion engine having intake and exhaust valves, and more particularly to a valve operating arrangement of an over-head cam type internal combustion engine.

2. Brief Description of the Prior Art

In an internal combustion engine now in use, a cam shaft is usually employed for achieving the opening and closing movements of the intake and exhaust valves. The cam shaft is driven by the crank shaft and converts the rotational movement of the crank shaft to the reciprocating movements (viz., the opening and closing movements) of the intake and exhaust valves with an aid of pivotally movable rocker arms. In this connection, a so-called over-head cam type engine is known as an engine which systematically and effectively mounts therein those parts of the valve operating mechanism. However, as will become apparent as the description proceeds, some of the engines of such type have suffered from drawbacks originating from a poor-supported arrangement of the valve operating mechanism.

BRIEF SUMMARY OF THE INVENTION

According to the present invention, there is provided an improved valve operating arrangement of an over-head cam type internal combustion engine, which assures a quite stable arrangement or construction of the valve operating mechanism.

According to the present invention, there is provided a valve operating arrangement of an over-head cam type internal combustion engine, which comprises a cylinder head having thereon a cam shaft on which cams are securely mounted to rotate therewith about the axis of the cam shaft, a monoblock supporting member detachably mounted on the cylinder head, valve lifters operatively supported by the supporting member, one end of each valve lifter being in contact with the corresponding cam on the cam shaft, and a rocker shaft mounted on the supporting member and pivotally supporting thereon rocker arms, one end of each rocker arm being in contact with the other end of the corresponding valve lifter.

BRIEF DESCRIPTION OF THE DRAWINGS

Objects and advantages of the present invention will become clear from the following description when taken in conjunction with the accompanying drawings, in which:

FIGS. 3A and 3B show an exploded view of a valve operating arrangement of the present invention, in which FIG. 3A shows a monoblock supporting member, a rocker arm and a rocker shaft, and FIG. 3B shows a cylinder head and a cam shaft;

DESCRIPTION OF THE CONVENTIONAL VALVE OPERATING ARRANGEMENTS

Figure 1:
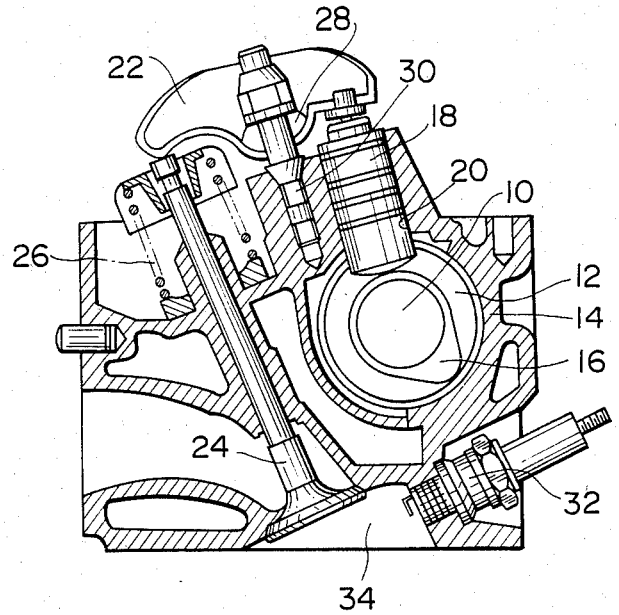
FIG.1 (PRIOR ART)
FIG. 1 is a sectional view of a conventional valve operating arrangement of an over-head cam type internal combustion engine, which arrangement has a drawback which can be solved by the present invention.
Figure 2:
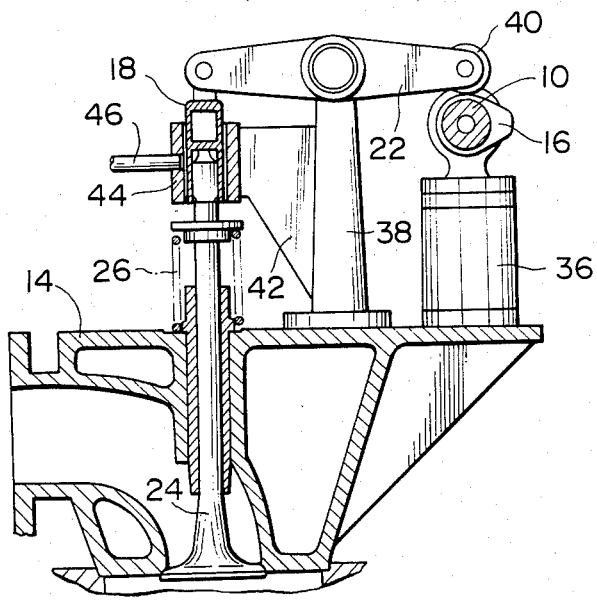
FIG.2 (PRIOR ART)
FIG. 2 is a sectional view of another conventional valve operating arrangement of an over-head cam type internal combustion engine, which arrangement has another drawback which can be solved by the present invention.

Prior to describing in detail a valve operating arrangement of the present invention, two conventional valve operating arrangements will be outlined with reference to FIGS. 1 and 2 in order to clarify the present invention. In the drawings, like numerals are used to denote similar elements.

Referring to FIG. 1, there is shown a conventional valve operating arrangement of an internal combustion engine, which is disclosed in Japanese Patent Application Secondary Publication No. Sho. 55-8647. The arrangement is of a so-called over-head cam type, which comprises a cam shaft 10 extending in a bore 12 formed in a cylinder head 14 of the engine. Cams 16 are securely mounted on the cam shaft 10 to rotate therewith about the axis of the shaft 10. Valve lifters 18 (oil tappets) are axially movably received in holes 20 of the cylinder head 14, abutting at their lower ends on respective cams 16. The upper end of each lifter 18 is projected outwardly from the cylinder head 14 to contact with one end of a corresponding rocker arm 22 of which other end is in contact with a top of a stem of a valve 24 (which is either an intake valve or an exhaust valve). The valves 24 are biased to assume their closed positions by coil springs 26 mounted on the cylinder head 14. Each rocker arm 22 is pivotally held by a stud bolt 30 through a ball joint 28, which bolt is fixed to the cylinder head 14. Designated by numeral 32 is a spark plug which is projected into a combustion chamber 34.

With the arrangement as described hereinabove, the rotation of the cam shaft 10 induces, in order, a reciprocating movement of each valve lifter 18, the pivoting movement of each rocker arm 22, and thus the reciprocating movement of each valve 24. Thus, each valve 24 repeats its closing and opening operations under operation of the engine.

However, the conventional arrangement as described above has a tendency to cause, particularly when the engine is under high speed operation, a non-smooth movement of each valve 24 inducing a power loss of the engine. This undesirable tendency is caused by a poor supporting function of each stud bolt 30 to the associated rocker arm 22. In fact, long time usage of the arrangement tends to produce a notable play of each rocker arm 22 relative to the associated stud bolt 30 thereby worsening the movement transmission from the lifter 18 to the valve 24.

Beside, since the arrangement necessitate to provide the cylinder head 14 per se with holes for receiving (or holding) the valve lifters 18 and the stud bolts 30, a measure has been applied to the portion where the holes are positioned, in order to increase the mechanical strength of that portion. Usually, the measure comprises thickening of that portion. However, this measure results in gross and heavy construction of the cylinder head. In addition to this, boring such hole in the cylinder head 14 is troublesome because of the complicated construction of the same.

Referring to FIG. 2, there is shown another conventional valve operating arrangement of an internal combustion engine, which is disclosed in U.S. Pat. No. 2,521,176. The arrangement is of a over-head cam type, which comprises a cam shaft 10 rotatably supported on brackets 36 mounted on the cylinder head 14. Cams 16 are securely mounted on the cam shaft 10 to rotate therewith. Rocker supporters 38 are mounted on the cylinder head 14 beside the brackets 36 for pivotally supporting thereon rocker arms 22. One end of each rocker arm 22 carries a cam roller 40 contacting one of the cams 16. The other end of each rocker arm 22 engages with a top of a stem of a valve 24 through a valve lifter 18 (oil tappet). The valves 24 are biased to assume their closed positions by coil springs 26 mounted on the cylinder head 14. As shown, each rocker supporter 38 is formed with a laterally extending bracket portion 42 of which leading end is formed into a tubular support 44 for slidably receiving therein the valve lifter 18. Designated by numeral 46 is a conduit for applying each tubular support 44 with a lubricant oil.

With the arrangement as described hereinabove, the rotation of the cam shaft 10 induces pivoting movement of each rocker arm 22, and thus the reciprocating movement of each valve 24. As is known, the valve lifter 18 (oil tappet) functions to automatically take up the clearance that exists between the valve stem and the lifter 18.

However, the conventional arrangement has the following drawbacks. When this arrangement is employed in a multi-cylinder type internal combustion engine, a number of rocker supporters 38 are inevitably necessitated thereby causing a high possibility of mispositioning of them on the cylinder head 14 during their assembly. Besides, assembling them on the cylinder head 14 requires troublesome and time-consumed work. In fact, each rocker arm 38 and its associated parts are independently applied to one of the combination chambers, so that piping of the lubricant oil supplying system becomes very complicated because of their independent constructions.

DETAILED DESCRIPTION OF THE INVENTION

Therefore, it is an essential object of the present invention to provide an improved valve operating arrangement of an internal combustion engine, which is free of the above-mentioned drawbacks.

Figure 3A:
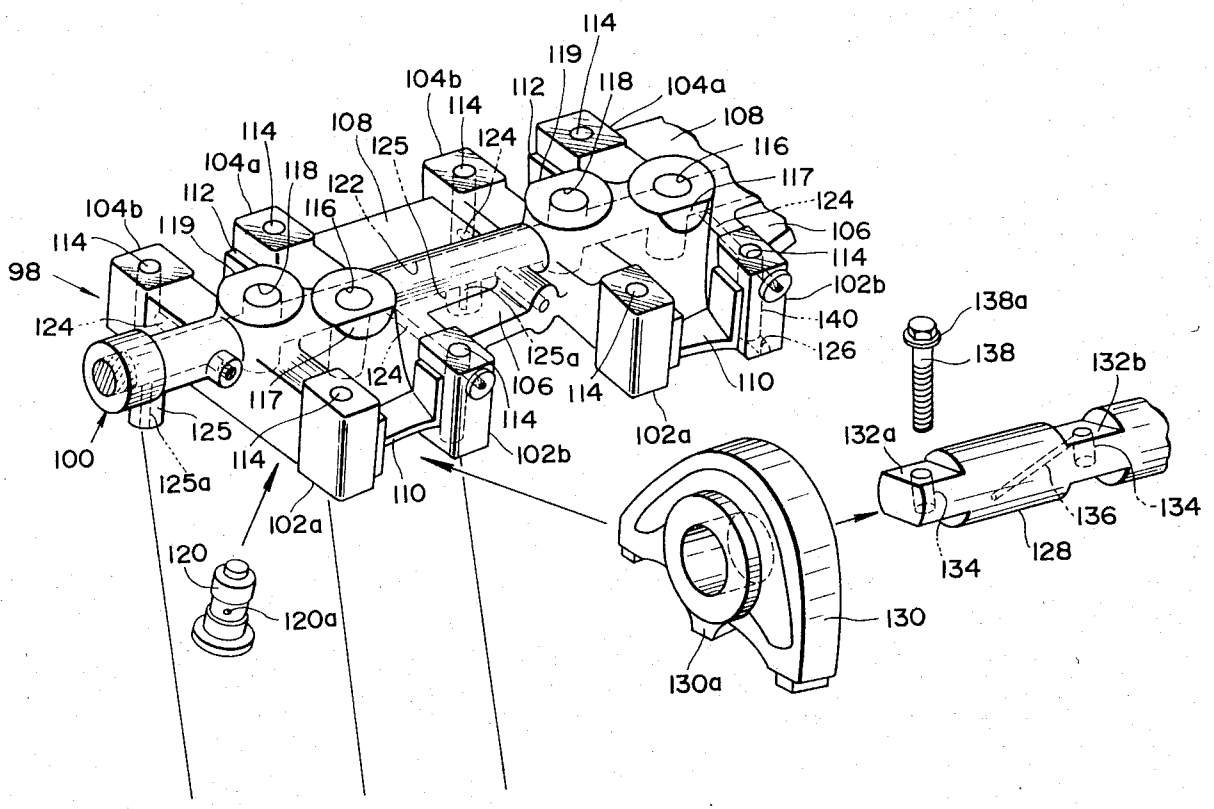
Figure 3B:
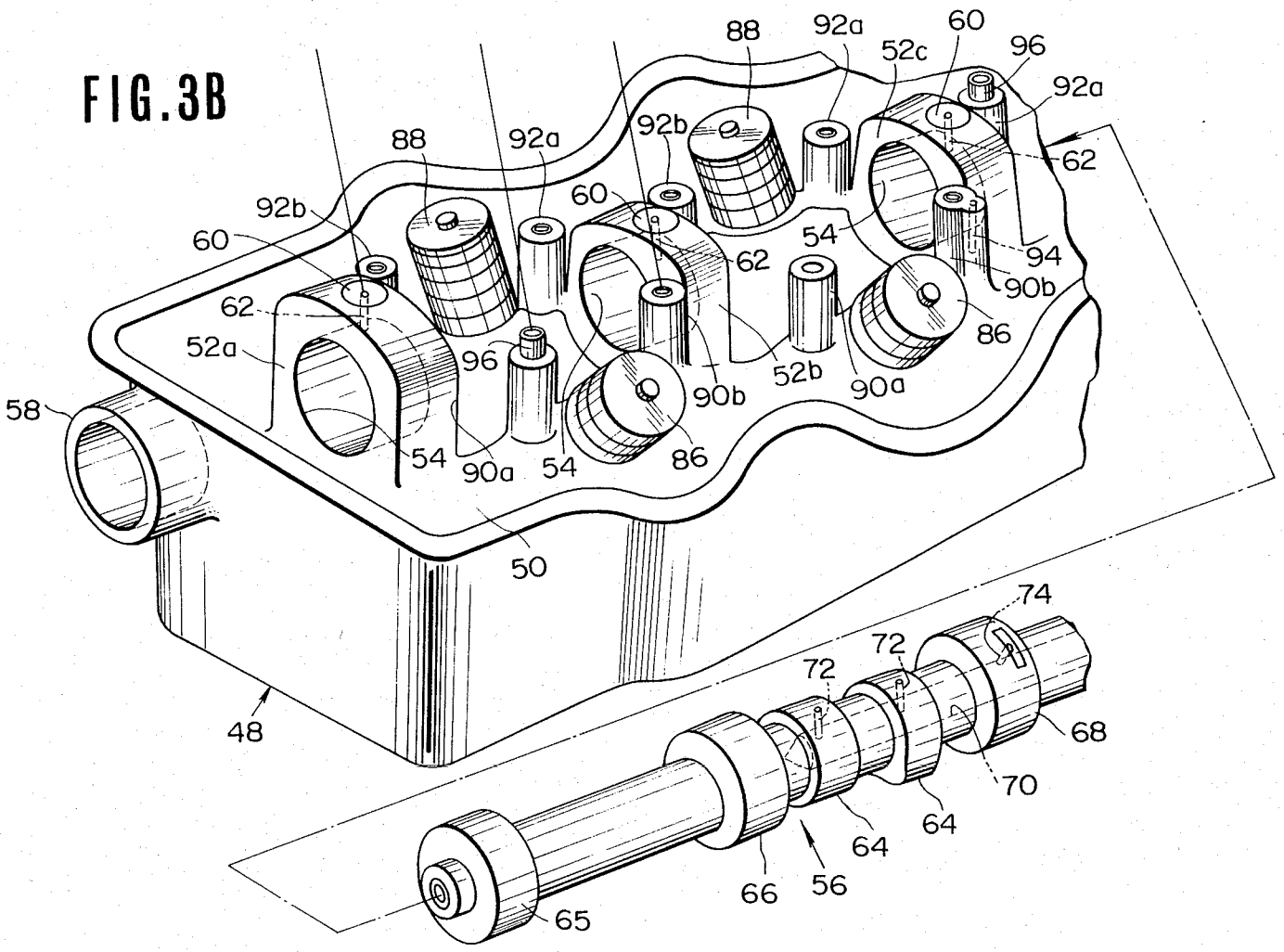

Referring to FIGS. 3A, 3B, 4 and 5, there is shown an improved valve operating arrangement according to the present invention. In order to facilitate the description on the arrangement, the following description will be commenced with respect to the construction of each part of the arrangement employed in the invention with reference to FIGS. 3A and 3B. In FIG. 3B, there is shown a cylinder head 48 of a cross-flow type internal combustion engine to which the valve operating arrangement of the invention is practically applied. The cylinder head 48 has at its upper portion a generally rectangular recess 50 which extends along the longitudinal axis of the cylinder head 48. A plurality of bearing portions **52*a*, 52*b*, 52*c* are axially spacedly arranged in the recess 50, each having a cylindrical bearing hole 54 for operatively receiving therein an elongate cam shaft 56. Designated by numeral 58 is a collar portion which is projected outwardly from the cylinder head 48 in a manner to be aligned with the inside positioned bearing portions 52*a*, 52*b*, 52*c*. Each of the bearing portions 52*a*, 52*b*, 52*c* is formed with a circular flat top 60 from which a small passage 62 for a lubricant oil extends inward to each hole 54. The cam shaft 56 has spaced cams 64 and spaced annular rings 65, 66 and 68 which are all securely or integrally mounted on the shaft 56 to rotate therewith. The cam shaft 56 is formed with an axially extending lubricant oil passage 70 from which small passages 72 and 74 extend to the outer surfaces of the cams 64 and the ring 68. The small passage 74 of the annular ring 68** is enlarged at its exit portion, as shown.

Figure 4:
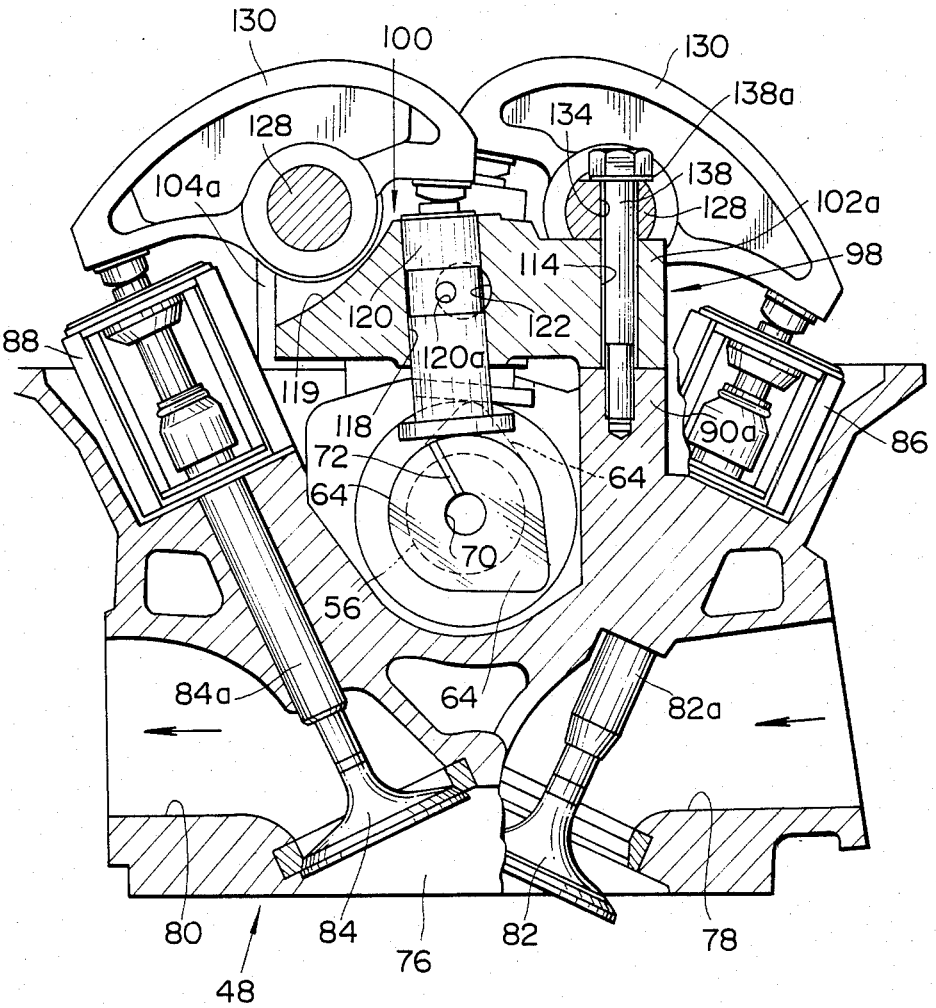
FIG. 4 is a laterally sectional view of the valve operating arrangement of the invention in the assembled condition, which view is taken along the line IV—IV of FIG. 5.

As will be understood from FIG. 4, a plurality of combustion chambers 76 are formed in the cylinder head 48, which are positioned under the aligned bearing portions **52*a*, 52*b*, 52*c*. Each combustion chamber 76 has intake and exhaust ports 78 and 80 which extend therefrom in the opposite directions to the lateral sides of the cylinder head 48. Intake and exhaust valves 82 and 84 are associated with their corresponding intake and exhaust ports 78 and 80 to selectively close and open them. The stems 82*a* and 84*a* of the intake and exhaust valves 82 and 84 are axially movably received in diagonally extending holes (no numerals) formed in the cylinder head 48. Coil springs 86 and 88 are associated with the valve stems 82*a* and 84*a* to bias the valves 82 and 84 toward their closed positions. The coil springs 86 and 88 are exposed to the recess 50 of the cylinder head 48**.

Referring again to FIG. 3B, the coil springs 86 and 88 are located at obliquely opposed positions with respect to an imaginary line on which the bearing portions **52*a*, 52*b*, 52*c* stand. Stud portions 90*a*, 90*b*, 92*a*, 92*b* are projected upwardly in the recess 50, and stand on opposite sides of the imaginary line thereby to provide two rows of them along the imaginary line. All of these stud portions are formed with threaded bores (no numerals). At least one of the stud portions 90*b* is formed with a small oil passage 94 which leads to an oil gallery (not shown) formed in the cylinder head 48 into which a pressurized lubricant oil flows from an oil supply source (not shown). Designated by numerals 96 are positioning tube members which are fitted to the bores of selected some of the stud portions 90*a* and 92*a*** for the purpose which will become apparent as the description proceeds.

As shown in FIG. 3A, a frame-like supporting member 98 is employed in the invention, which is to be bolted to the stud portions **90*a*, 90*b*, 92*a*, 92*b* of the cylinder head 48 for assurely supporting thereon a rocker arm assembly and valve lifters. Preferably, the supporting member 98 is constructed of aluminium. As seen from the drawing, the supporting member 98 comprises generally an elongate major portion 100 and a plurality of laterally extending leg portions 102*a*, 102*b*, 104*a*, 104*b*. The leg portions 102*a* and 102*b* and the other leg portions 104*a* and 104*b* extend in opposite directions thereby to provide two groups of leg portions beside the main portion 100. As is seen from FIG. 5, the two groups of leg portions are alternately arranged with respect to the longitudinal axis of the elongate main portion 100, so that each clearance between the adjacent leg portions 102***a* and 102*b* on one group is located at the diagonally opposed position of the corresponding each clearance between the legs 104*a* and 104*b* of the other group with respect to the axis of the elongate main portion 100, i.e., the leg portions 102*a*, 102*b* are staggered with respect to the leg portions 104*a*, 104*b*. As will become apparent as the description proceeds, the adjacent leg portions 102*a* and 102*b* on one group and the adjacent leg portions 104*a* and 104*b* on the other group from a unit which serves one combustion chamber 76. The leg portion 102*b* of one unit and the leg portion 102*a* of the other unit are connected by an integral reinforcing rib 106, while, the leg portion 104*a* of one unit and the leg portion 104*b* of the other unit are integrally connected by a reinforcing plate portion 108. The adjacent two leg portions 102*a* and 102*b* and the adjacent two leg portions 104*a* and 104*b* of each unit are equipped therebetween with strut members 110 and 112. With these parts and portions, the mechanical strength of the supporting member 98 is increased sufficiently. The leading end of each leg portion is shaped like a rectangular column, and has a through hole 114. For the reason which will become apparent hereinafter, the diameter of each hole 114 is considerably greater than that of the after-mentioned threaded bolt (138). Each unit of the supporting member 98 is formed with a pair of inclined through holes 116 and 118 at the elongate main portion 100 thereof. Circular top sections of the holes 116 and 118 are formed with chamfered portions 117 and 119 for facilitating the assembly of after-mentioned rocker arms 130. Upon assembly, a valve lifter 120 (oil tappet) is axially slidably received in each of the through holes 116 and 118, as is seen from FIG. 4. The lifter 120 has an opening 120*a* through which a lubricant oil is supplied thereinto. The elongate main portion 100 of the supporting member 98 is formed with an axially extending oil passage 122 to which the inclined through holes 116 and 118 are exposed, and from which small passages 124 extend to the through holes 114 of selected leg portions 102*b* and 104*b*. Preferably, the passage 122 is provided by using, upon casting of the supporting member 98, a stainless tube as a core. This method provides the passage 122 with smooth wall surface. The diameter of the oil passage 122 is considerably greater than that of each small passage 124. The elongate main portion 100 is provided with axially spaced downward projections 125 each having a small passage exposed to the larger diameter oil passage 122. One of the leg portions, that is, the leg portion 102*b* shown at the right-upper section of FIG. 3A is formed at its bottom surface with a groove 126 which terminates at a portion inside the leg portion 102*b*. The construction of this portion will be described in detail hereinafter.

Figure 7:
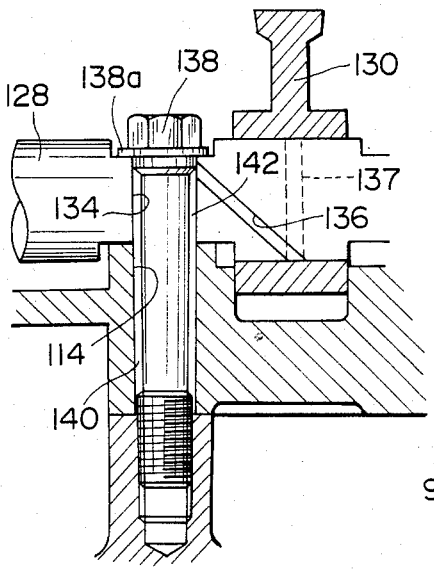
FIG. 7 is a sectional view taken along the line VII—VII of FIG. 5.

The rocker shafts 128 pivotally mounting thereon several paired rocker arms 130 are securely mounted on the two groups of leg portions 102*a*, 102*b*, 104*a*, 104*b* of the supporting member 98, respectively. Each rocker arm 130 is provided with a downward projection 130*a* for facilitating the positioning thereof to the supporting member 98. As is understood from FIG 3A, each rocker shaft 128 is constructed of a solid rod member and formed with axially spaced several mount portions 132*a* and 132*b*, each comprising diametrically opposed flat portions. The mount portions 132*a* are respectively formed with bolt holes 134. For the reason which will become apparent hereinafter, the diameter of the hole 134 of at least the mount portion 132*b* is considerably greater than that of the after-mentioned threaded bolt which is used for connecting the rocker shaft 128 and the supporting member 98 to the cylinder head 48. A small oil passage 136 is formed in the rocker shaft 128, which extends diagonally from the hole 134 of the selected mount portion 132*b* to the cylindrical outer surface of the shaft 128 on which the rocker arm 130 is slidably and pivotally mounted. As shown in FIG. 7, the oil passage 136 extends downwards to the lower side of the rocker shaft 128. If desired, a diametrically extending hole 137 may be provided, which extends from the passage 136.

In the following, assembly of the valve operating arrangement of the invention will be described with reference to FIGS. 3A, 3B, 4 and 5.

Figure 5:
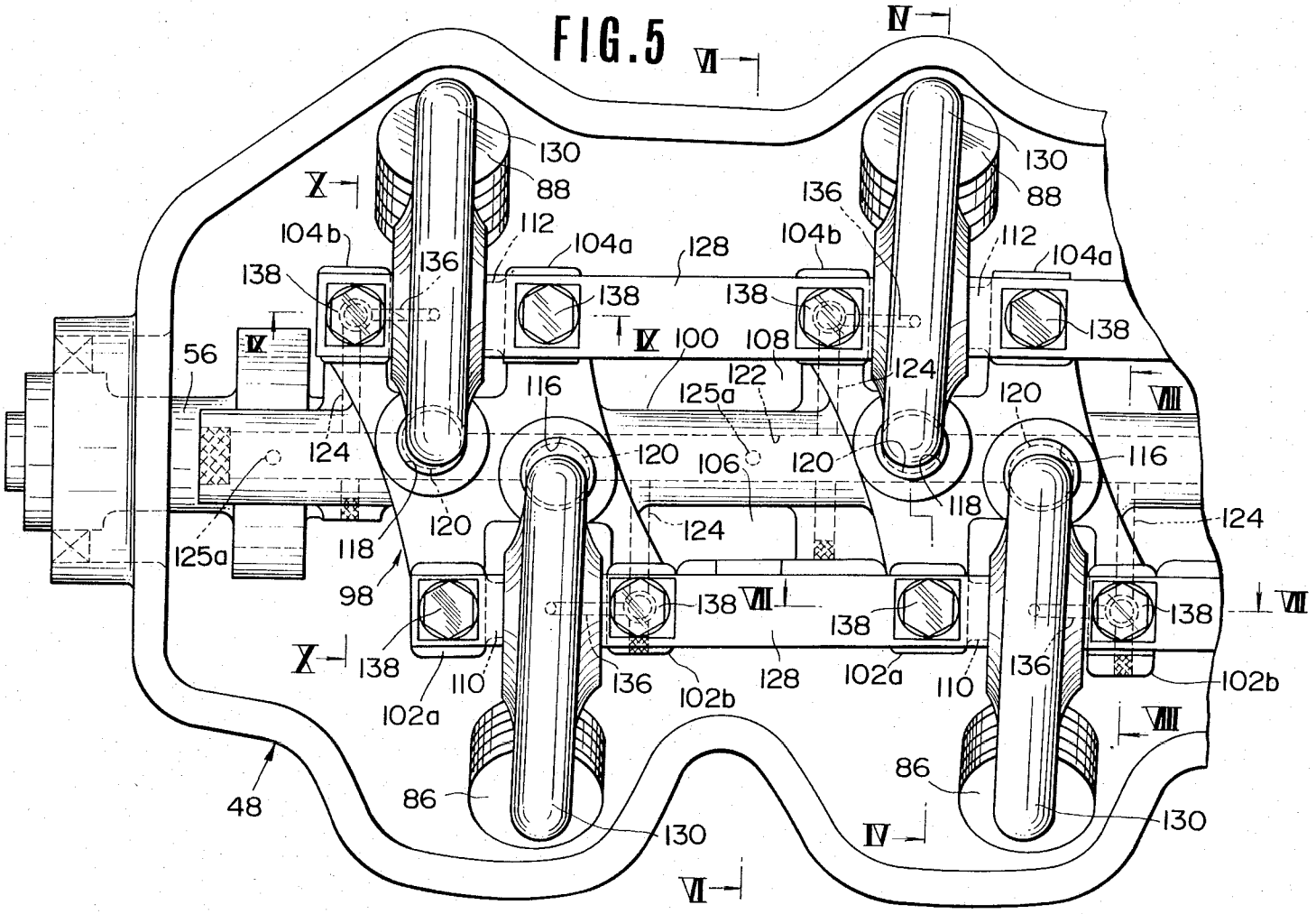
FIG. 5 is a plan view of the valve operating arrangement of the present invention.
Figure 6:
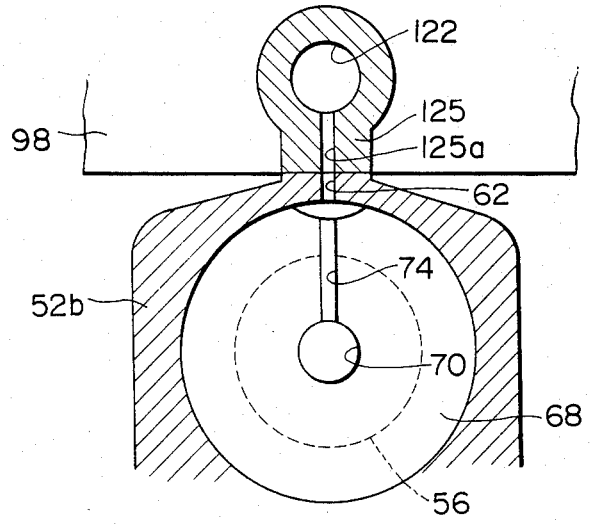
FIG. 6 is a sectional view taken along the line VI—VI of FIG. 5.

The cam shaft 56 is received in the aligned bearing portions 52*a*, 52*b*, 52*c* . . . and 58 in such an arrangement that the ring portions 65, 66 and 68 are rotatably supported by the bearing portions 58, 52*a* and 52*b*, respectively. Thus, the paired cams 64 shown in FIG. 3B are located between the bearing portions 52*a* and 52*b*, and the other paired cams 64 (not shown) on the right side of the ring portion 68 of FIG. 3B are located between the bearing portions 52*b* and 52*c*. The frame-like supporting member 98 is mounted or seated at their rectangular column portions of the leg portions 102*a*, 102*b*, 104*b*, 104*a*, in one to one relation, on the stud portions 90*a*, 90*b*, 92*b*, 92*a*, with the valve lifters 120 slidably received in the inclined through holes 116 and 118 of the member 98. It is to be noted that this mounting is precisely and easily achieved because of the provision of the positioning tube members 96 previously fitted to the selected stud portions 90*a* and 92*a* (see FIG. 3B). Thus, the downward projections 125 (which have therein oil passages 125*a*) of the supporting member 98 are precisely mated with the circular flat tops 60 of the inside positioned bearing portions 52*a*, 52*b*, 52*c* of the cylinder head 48. The two rocker shafts 128 each mounting thereon associated rocker arms 130 are mounted respectively on the rectangular column portions of the two groups of the leg portions 102*a*, 102*b*, 104*b*, 104*a*, in such a manner that the mount portions 132*a* and 132*b* of each rocker shaft 128 fit on the column portions 102*a* and 102*b* (or, 104*b* and 104*a*) of each group. With this, the holes, for example the holes 134 of the rocker shaft 128, the holes, for example, the hole 114 of the leg portion 102*a* of the one unit and the holes, for example the hole of the stud portion 90*a* of the cylinder head 48 become aligned. Threaded bolts 138 each having a seal flange 138*a* are inserted in the aligned holes and screwed to the stud portions 90*a*, 90*b*, 92*b*, 92*a* of the cylinder head 48, so that the rocker shaft 128 and the supporting member 98 are securely mounted on the cylinder head 48 in a manner as shown in FIGS. 4 and 5.

As is understood from FIG. 4, the valve lifters 120 in the through holes 116 and 118 of the supporting member 98 contact at their lower ends with the associated cams 64 of the cam shaft 64, and at their upper ends with the inside ends of the associated rocker arms 130. The outside ends of the rocker arms 130 contact with the upper ends of the stems 82*a* and 84*a* of the associated intake and exhaust valves 82 and 84. Thus, rotation of the cams 64 induce, in order, the reciprocating movements of the valve lifters 120, the pivoting movements of the rocker arms 130 and the reciprocating movements of the intake and exhaust valves 82 and 84. Thus, the opening and closing operations of the valves 82 and 84 occur in response to the rotation of the cam shaft 56 about its axis.

In the following, a lubricant oil supplying system formed in the above-mentioned assembled valve operating arrangement will be described in detail with reference to FIGS. 3A to 9.

Figure 8:
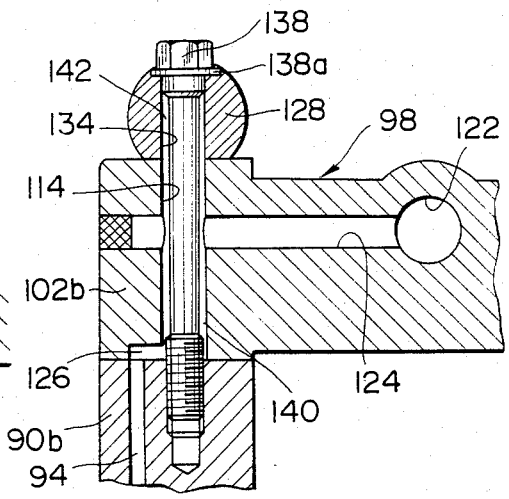
FIG. 8 is a sectional view taken along the line VIII—VIII of FIG. 5.
Figure 9:
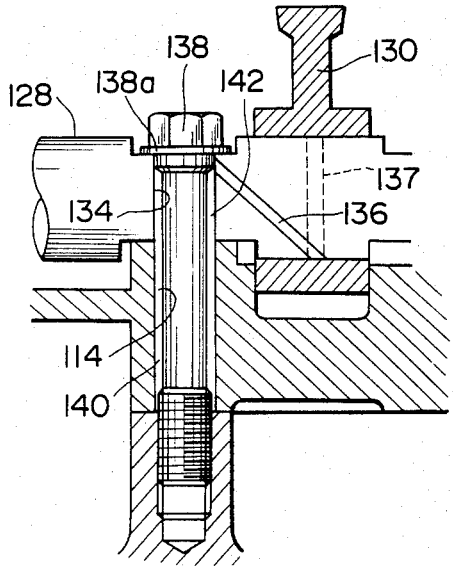
FIG. 9 is a sectional view taken along the line IX—IX of FIG. 5.
Figure 10:
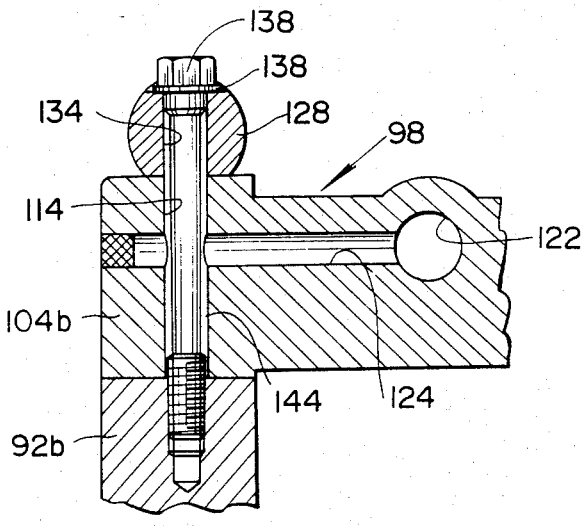
FIG. 10 is a sectional view taken along the line X—X of FIG. 5.

As is understood from FIGS. 3A, 3B and 8, upon assembly, the stud portion 90*b* of the cylinder head 48, the leg portion 102*b* of the supporting member 98 and the rocker shaft 128 are secured or united by the bolt 138 to form a first oil supplying way which comprises the small oil passage 94 of the stud portion 90*b, the groove 126 of the leg portion 102b,* the cylindrical gap 140 defined between the bolt 138 and the wall of the hole 114 of the leg portion 102*b*, the cylindrical gap 142 defined between the bolt 138 and the wall of the hole 134 of the rocker shaft 128, and the inclined passage 136 (see FIG. 7) defined in the rocker shaft 128. The cylindrical gap 140 is connected to the relatively large diameter longitudinally extending oil passage 122 of the supporting member 98 through the small passage 124, as is best seen in FIG. 8. As is understood from FIGS. 3A, 3B and 10, upon assembly, the stud portion 92*b* of the cylinder head 48, the leg portion 104*b* of the supporting member 98 and the other rocker shaft 128 (not shown in FIG. 3A) are secured or united by the bolt 138 to form a second oil supplying way which comprise the cylindrical gap 144 defined between the bolt 138 and the wall of the hole 114 of the leg portion 104*b*, the cylindrical gap 146 defined between the bolt 138 and the wall of the hole 134 of the other rocker shaft 128, and the inclined passage 136 (see FIG. 9) defined in the other rocker shaft 128. The cylindrical gap 144 is connected to the oil passage 122 of the supporting member 98 through the small passage, as is best seen in FIG. 10. Furthermore, upon assembly, as is understood from FIGS. 3A, 3B and 6, the downward projections 125 of supporting member 98 are respectively mated with or seated on the inside positioned bearing portions 52*a, 52b* 52*c* of the cylinder head 48 to form respectively a third oil supplying way which comprises the oil passage 122, the small passage 125*a* of the downward projection 125 and the small passage 62 of the bearing portion 52*a*, 52*b* or 52*c* of the cylinder head 48. As is seen from FIG. 6, the oil supplying way associated with the stud portion 52*b* further comprises the small passage 74 formed in the ring portion 68 of the cam shaft 56, the axially extending oil passage 70 in the cam shaft 56 and the small passages 72 of the cams 64 mounted on the cam shaft 56.

Thus, a pressurized lubricant oil from the oil gallery (not shown) formed in the cylinder head 48 is supplied through the first oil supplying way (which comprises the passages 94, 126, 140, 142, 136 and 124) to not only the rotatably supported beared portion of the rocker arm 130 of FIG. 7 but also the larger diameter oil passage 122 of the supporting member 98. The pressurized oil in the passage 122 is supplied through the second oil supplying ways (each of which comprises the passages 124, 144, 146 and 136) to the beared portions of the other rocker arms 130. The pressurized oil in the passage 122 is then supplied through the third oil supplying ways (each of which comprises the passages 125*a* and 62) to the rotatably supported portions of the ring portions 66, 68, of the cam shaft 70. The pressurized oil in the passage 62 of the bearing portion 52 is permitted to flow into the passage 70 of the cam shaft through the passage 74 in response to rotation of the cam shaft 56. The oil in the passage 70 is supplied through the passages 72 to the rotatably supported portions of the cams 64. With the oil feeding, the moving parts of the valve operating arrangement are smoothly and lubricantly beared by their associated parts.

Figure 11:
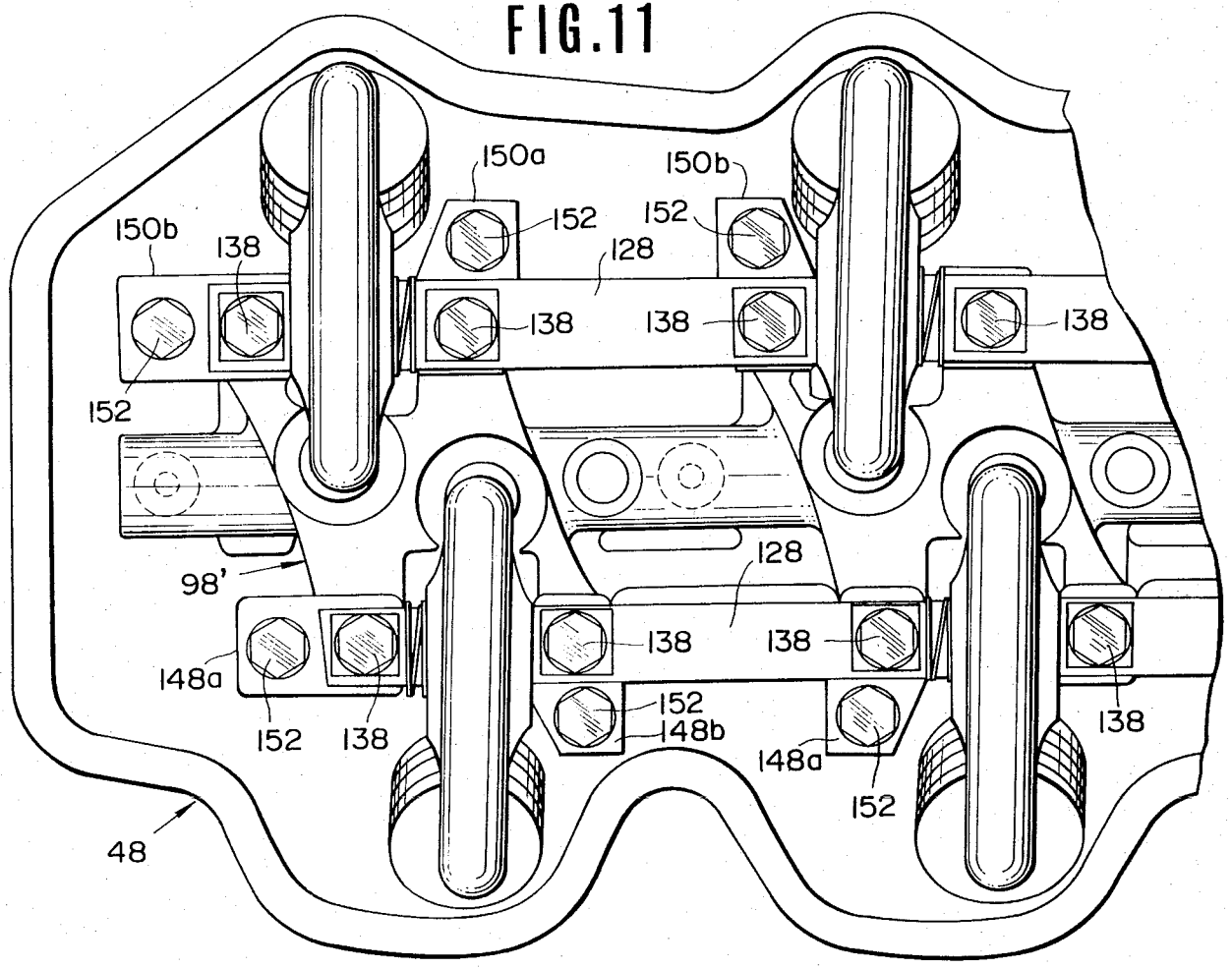
FIG. 11 is a view similar to FIG. 5, but showing a modification of the valve operating arrangement of the invention.

Referring to FIG. 11, there is shown a slight modification of the valve operating arrangement of the present invention. The supporting member 98' employed in this modification has substantially the same construction as the afore-mentioned supporting member 98 except for the construction of the leg portions. As is understood when comparing FIG. 11 with FIG. 5, the supporting member 98' of this modification has leg portions 148*a*, 148*b*, 150*b* and 150*a* which are larger or longer than the corresponding leg portions 102*a*, 102*b*, 104*b* and 104*a* of FIG. 5. The leading end of each leg portion 148*a*, 148*b*, 150*b* and 150*a* has a through hole through which a threaded bolt 152 passes to be screwed to the cylinder head 48. Unlike the arrangement in FIG. 5, the threaded bolts 138 employed in this modification function to only secure the rocker shafts 128 to the supporting member 98'. This modification may be practically used when the cylinder head 48 has a limited parts-mounting space.

In the following, advantages given by the present invention will be described, comparing the case of the invention with the cases of the afore-mentioned conventional valve operating arrangements of FIGS. 1 and 2.

1. Unlike the cases of the conventional arrangements, in the present invention, the rocker arms 130 are reliably and assuredly held by the rocker shafts 128 which are tightly mounted on the monoblock supporting member 98 (or 98') which is tightly seated on the cylinder head 48. Thus, the undesirable tendency (which may cause the power loss of the engine originating from the poor supporting arrangement of the rocker arms) appearing in the conventional arrangements does not appear in the present invention. In fact, the arrangement provided by the invention enables the associated engine to run very smoothly even under high speed operation.

2. As compared with the cases of the conventional arrangements, the construction of the cylinder head 48 employed in the invention is quite simple because of the employment of the separate supporting member 98 (or 98'). In fact, the supporting member mounts thereon many parts which have been directly mounted on the cylinder head in the conventional arrangement. Such simplification in construction of the cylinder head induces low cost and light weight engine construction.

3. Positioning of the supporting member 98 (or 98') onto the cylinder head 48 can be easily and precisely achieved by the provision of the positioning tube members 96 which are previously fitted to the selected stud portions 90*a* and 92*a*. The monoblock construction of the supporting member permits itself to act as an excellent positional base member for parts mounted thereon when arranged on the cylinder head 48.

4. The lubricant oil supplying system for lubricant of the parts of the valve operating arrangement is substantially provided by or formed in the separate supporting member 98 in the preseent invention, unlike the cases of the conventional arrangements. This measure induces simplified construction of the cylinder head 48. The measure is highly evaluated when considering that forming the oil flow passages in the cylinder head is more difficult than forming such passages in the separate supporting member.

5. The longitudinally extending oil passage 122 in the supporting member 98 (or 98') is greater in diameter than the small passage 124 (of the leg portion 102*b*) through which the pressurized lubricant oil is fed into the passage 122. Thus, the passage 122 can act as a so-called oil strainer, so that even when air bubbles are contained in the lubricant oil fed from the small passage 124, such air bubbles are separated in the passage 122. Thus, the valve lifters 120, namely, the oil tappets received in the holes 116 and 118 are supplied with oil containing no air bubbles.

6. Providing the supporting member 98 (or 98') with the inclined holes 116 and 118 for the valve lifters 120 means reduction in thickness of the member 98 (or 98'). This measure induces compact construction of the member.

7. Approximately half of the holes 114 formed in the leg portions of the supporting member 98 (or 98') serve as bolt holes and oil passages. This measure induces the simplified construction of the supporting member.

8. The rocker shafts 128 employed in the present invention are constructed of a solid rod member. This means not only a steady mounting of the rocker shafts to the supporting member 98 (or 98'), but also a steady mounting of the rocker arms to the rocker shafts.

What is claimed is:

1. A valve operating arrangement of an over-head cam type internal combustion engine, comprising:

a cylinder head operatively carrying thereon a cam shaft on which cams are securely mounted to rotate therewith;

a monoblock supporting member detachably mounted on said cylinder head, said supporting member having a unit serving a combustion chamber of said engine, said unit comprising an elongated major portion having a longitudinal axis and groups of leg portions on opposite sides of said axis connected by said major portion and adapted to be seated on said cylinder head, leg portions of each group being longitudinally spaced with respect to each other and staggered with respect to leg portions of an opposite group, said elongated major portion of said unit of said supporting member having a pair of longitudinally arranged through holes adjacent said axis and located between opposite groups of leg portions in alignment with corresponding cams on said cam shaft;

valve lifters slidably received in said through holes of said supporting member, one end of each valve lifter being in contact with the corresponding cam on said cam shaft; and a rocker shaft mounted on said supporting member between spaced leg portions of each group pivotally supporting thereon a rocker arm, one end of each rocker arm being in contact with the other end of one of said valve lifters.

2. A valve operating arrangement as claimed in claim 1, in which said cylinder head is formed with a plurality of upwardly projecting stud portions, said leg portions of said supporting member being seated on said stud portions in one to one relationship upon properly mounting said supporting member on said cylinder head.

3. A valve operating arrangement as claimed in claim 2, in which some of said leg portions have respective extensions each have a through hole through which a connecting bolt passes to be screwed to said cylinder head for securely mounting said supporting member onto said cylinder head.

4. A valve operating arrangement as claimed in claim 2, in which each of said stud portions is formed with a threaded hole, and each of said leg portions is formed with a through hole, said threaded hole and said through hole being brought into alignment with each other when said supporting member is properly mounted on said cylinder head, and in which a connecting bolt passes through the aligned holes and is screwed to said threaded hole of the stud portion to securely mount the supporting member to said cylinder head.

5. A valve operating arrangement as claimed in claim 4, in which an integral reinforcing member spans between said spaced leg portions of each group to increase the mechanical strength of said supporting member.

6. A valve operating arrangement as claimed in claim 1, in which said monoblock supporting member has therein a lubricant oil passage so that lubrication for said cam shaft, said cams, said valve lifters and said rocker arms is effected by a lubricant oil which flows through said lubricant oil passage of the supporting member.

7. A valve operating arrangement as claimed in claim 6, in which said through holes in which said valve lifters are slidably received have a portion exposed to said lubricant oil passage so that each valve lifter is supplied with the lubricant oil.

8. A valve operating arrangement as claimed in claim 6, in which said rocker shaft is of a solid rod member and has a small lubricant oil passage therein in order to effect the lubrication of each rocker arm.

9. A valve operating arrangement as claimed in claim 8, in which said lubricant oil passage of said supporting member has a plurality of branch passages each terminating at a portion exposed to the open air, one end of said small lubricant oil passage of said rocker shaft being mated with the terminating portion of each branch passage of said supporting member when said rocker shaft is properly mounted on said supporting member.

10. A valve operating arrangement as claimed in claim 9, in which one of said branch passages is used for carrying the lubricant oil from an external oil supplying source into said oil passage of said supporting member.

11. A valve operating arrangement as claimed in claim 9, in which said cylinder head is formed with a plurality of bearing portions by which said cam shaft is operatively supported, each of said bearing portions being formed with a small lubricant oil passage which extends from the bearing section proper for the cam shaft and terminates at a portion exposed to the open air, one of said branch passages of said supporting member being mated with the terminating portion of the small passage of each bearing portion of said cylinder head when said supporting member is properly mounted on the cylinder head.

12. A valve operating arrangement as claimed in claim 11, in which said cylinder head is formed with a plurality of threaded holes, said supporting member is formed with a plurality of through holes, and said rocker shaft is formed with a plurality of through holes, these holes of said cylinder head, said supporting member and said rocker shaft being aligned with one another, upon assembly of them, so that a common threaded connecting bolt passes through each of the aligned holes and is secrewed to the corresponding threaded hole of said cylinder head thereby to achieve tight assembly of them.

13. A valve operating arrangement as claimed in claim 12, in which the bolt holes of said supporting member act as a part of said branch passages of said supporting member, and in which the bolt holes of said rocker shaft act as a part of said small passages of said rocker shaft.

14. A valve operating arrangement as claimed in claim 13, in which some of said threaded holes of said cylinder head are equipped with positioning tube members which are put in the corresponding bolt holes of said supporting member when said supporting member is mounted on said cylinder head.

15. A valve operating arrangement as claimed in claim 11, in which said cam shaft is formed, at a portion rotatably supported by one of said bearing portions of said cylinder head, with a radially extending small passage which is open to an axially extending lubricant oil passage formed in said cam shaft, and in which each of said cams on said cam shaft is formed with a small lubricant oil passage which extends from each axially extending lubricant oil passage to the outer surface of said cam, whereby, upon operation of the engine, the lubricant oil fed into said axially extending lubricant oil passage through said radially extending small passage of the cam shaft is supplied to the outer surface of each cam through said small passage of each cam.

16. A valve operating arrangement as claimed in claim 15, in which said cylinder head is formed with a plurality of upwardly projecting stud portions each having therein said threaded hole therein, and in which said supporting member is formed with a plurality of leg portions some of which is formed with said branch passages therein, said leg portions of said supporting member being seated on said stud portions in one to one relationship when said supporting member is properly mounted on said cylinder head.

17. A valve operating arrangement as claimed in claim 16, in which the bolt holes of said supporting member are formed in said leg portions.

* * * * *